US007268654B2

(12) United States Patent
Dorn et al.

(10) Patent No.: US 7,268,654 B2
(45) Date of Patent: Sep. 11, 2007

(54) CIRCUIT BREAKER LATCHING MECHANISM

(75) Inventors: Jeremy D. Dorn, Marion, IA (US); Jeffrey M. Kaufman, West Liberty, IA (US); Kenneth L. Winter, Walford, IA (US); Cameron L. Woodson, Cedar Rapids, IA (US); Chad R. Mittelstadt, Cedar Rapids, IA (US)

(73) Assignee: Square D Company, Palatine, IL (US)

( * ) Notice: Subject to any disclaimer, the term of this patent is extended or adjusted under 35 U.S.C. 154(b) by 162 days.

(21) Appl. No.: 11/025,190

(22) Filed: Dec. 29, 2004

(65) Prior Publication Data

US 2005/0140479 A1 Jun. 30, 2005

Related U.S. Application Data

(60) Provisional application No. 60/533,552, filed on Dec. 31, 2003.

(51) Int. Cl.
*H01H 3/60* (2006.01)
*H01H 73/48* (2006.01)
*H01H 9/20* (2006.01)

(52) U.S. Cl. ..... 335/157; 335/22; 335/167; 335/168; 335/169

(58) Field of Classification Search ..... 335/6, 335/22, 157, 167–169
See application file for complete search history.

(56) References Cited

U.S. PATENT DOCUMENTS 4,001,739 A * 1/1977 Powell et al. ..... 335/34
6,628,185 B2 9/2003 Raabe et al. ..... 335/172

* cited by examiner

*Primary Examiner*—Ramon M. Barrera

(57) ABSTRACT

A latching mechanism for a movable member mounted for movement between first and second positions. The latching mechanism includes a primary latching mechanism mounted for movement between a latched position where the primary latching mechanism engages the movable member to allow the movable member to move between the first and second positions, and an unlatched position where the movable member is disengaged for movement to the second position. A secondary latching element engages the first latching mechanism to hold the primary latching mechanism in the latched position, the secondary latching element being movable to move the primary latching mechanism to the unlatched position while remaining in engagement with the primary latching mechanism.

20 Claims, 11 Drawing Sheets

CIRCUIT BREAKER LATCHING MECHANISM

CROSS-REFERENCE TO RELATED APPLICATION

This application claims benefit to U.S. Provisional Application No. 60/533,552, filed on Dec. 31, 2003, which is incorporated by reference in its entirety.

FIELD OF THE INVENTION

This invention is directed generally to electrical switch mechanisms. More particularly, this invention pertains to a latching mechanism that prevents circuit breaker nuisance tripping due to shock or vibration forces without impeding the intended circuit trip function.

BACKGROUND OF THE INVENTION

Circuit breakers are well-known devices used to provide automatic circuit interruption, to a monitored circuit, when circuit fault conditions occur. Fault conditions include, but are not limited to, current overload, ground faults, over voltage conditions and arcing faults. The release or disengaging of circuit breaker contacts to interrupt a monitored circuit is commonly referred to as tripping. The current interruption is usually achieved by having a movable contact (attached to a movable blade) that separates from a stationary contact (attached to a stationary blade). The movable contact is under considerable spring tension to move away from the stationary contact to open the circuit. When the movable contact separates from the stationary contact, it is important that this physical action occurs quickly and reliably to minimize arcing. If the arcing is too intense, it can affect the ability of the circuit breaker to open the faulted circuit. It is also important, in the design of circuit breaker trip mechanisms, that the force required to trip or open the circuit breaker mechanism is minimized.

In typical circuit breakers a latching mechanism is used to provide engagement of the circuit breaker contacts. When the circuit breaker contacts are closed or engaged, the latching mechanism holds the spring-loaded circuit breaker contacts together, and thus must resist the considerable spring force that causes the circuit breaker contacts to open when the latch is released. At the same time, the latching mechanism must be sensitive enough to trip and open the contacts with minimal force.

One of the disadvantages of many latching devices, is that the required sensitivity of the tripping mechanism makes them liable to inadvertent tripping due to shock and vibration. One of the sources of local shock vibrations is the actual act of manually closing the circuit breaker contacts. Since the breaker contacts must be closed as rapidly as they are released, the snap of closing the circuit breaker contacts sets up a shock vibration within the circuit breaker unit itself. This local vibration can cause an immediate nuisance trip. Therefore, various design solutions can be used to stabilize the breaker mechanism against shock and vibration forces. These designs, however, typically require greater energy to perform the intended trip function, which is undesirable.

SUMMARY OF THE INVENTION

In accordance with the present invention, there is provided an electrical circuit breaker including a latching mechanism for a movable member. The movable member is mounted for movement between first and second positions. The latching mechanism includes (1) a primary latching mechanism mounted for movement between a latched position where the primary latching mechanism engages the movable member to allow the movable member to move between the first and second positions, and an unlatched position where the movable member is disengaged for movement to the second position, and (2) a secondary latching element engaging the first latching mechanism to hold the primary latching mechanism in the latched position. The secondary latching element is movable to move the primary latching mechanism to the unlatched position.

The latching mechanism resists inadvertent forces tending to open the circuit breaker contacts when in the closed position, and thus makes the circuit breaker resistant to shock and vibration forces acting on the circuit breaker. Nuisance tripping of the breaker contacts can be virtually eliminated.

The latching mechanism can also be used in applications other than circuit breakers, where the movable member controls items other than circuit breaker contacts.

BRIEF DESCRIPTION OF THE DRAWINGS

The foregoing and other advantages of the invention will become apparent upon reading the following detailed description and upon reference to the drawings.

Figure 1A:
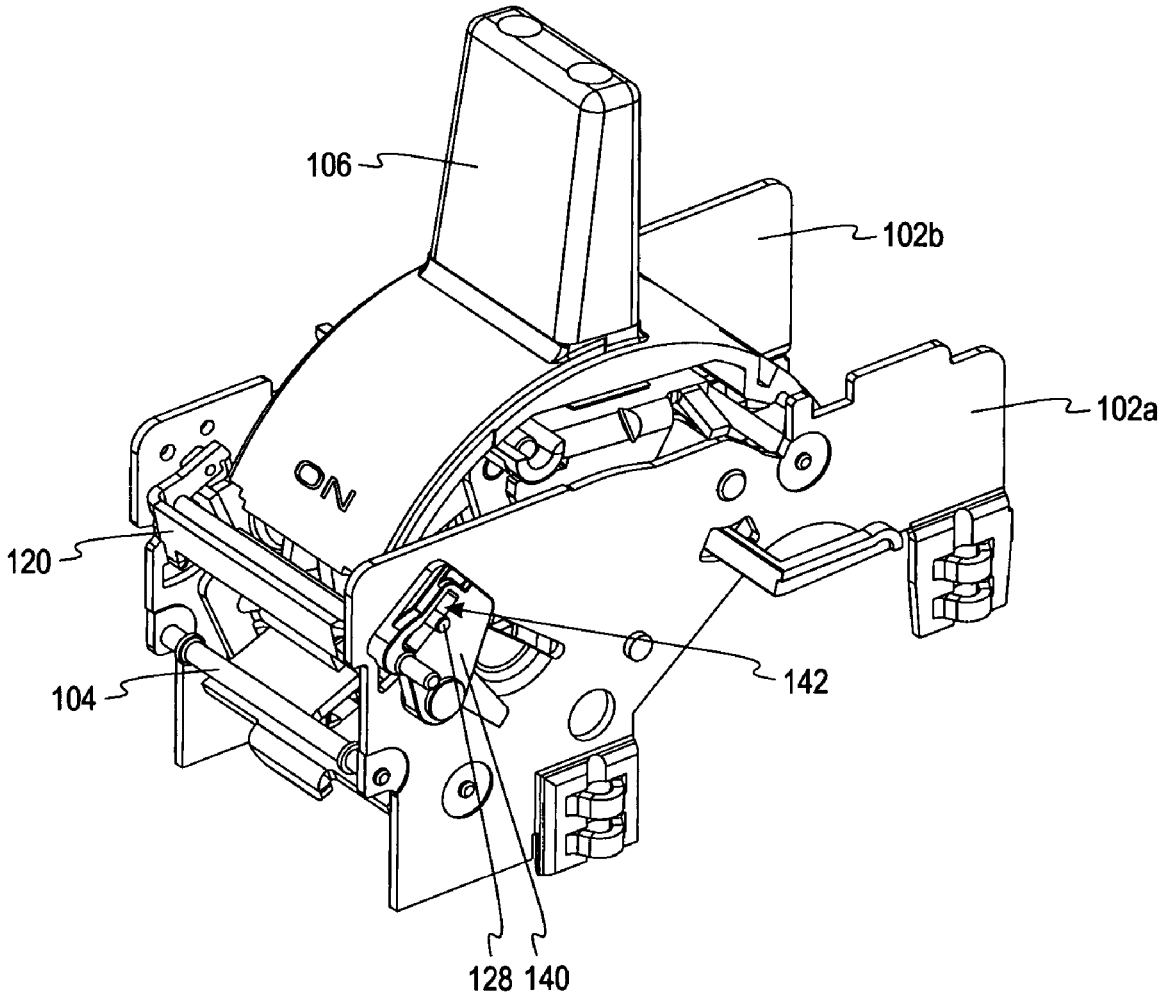
FIG. 1*a* is a perspective view of a circuit breaker incorporating one embodiment of the present invention, in the disengaged or tripped condition.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENT

Figure 1B:
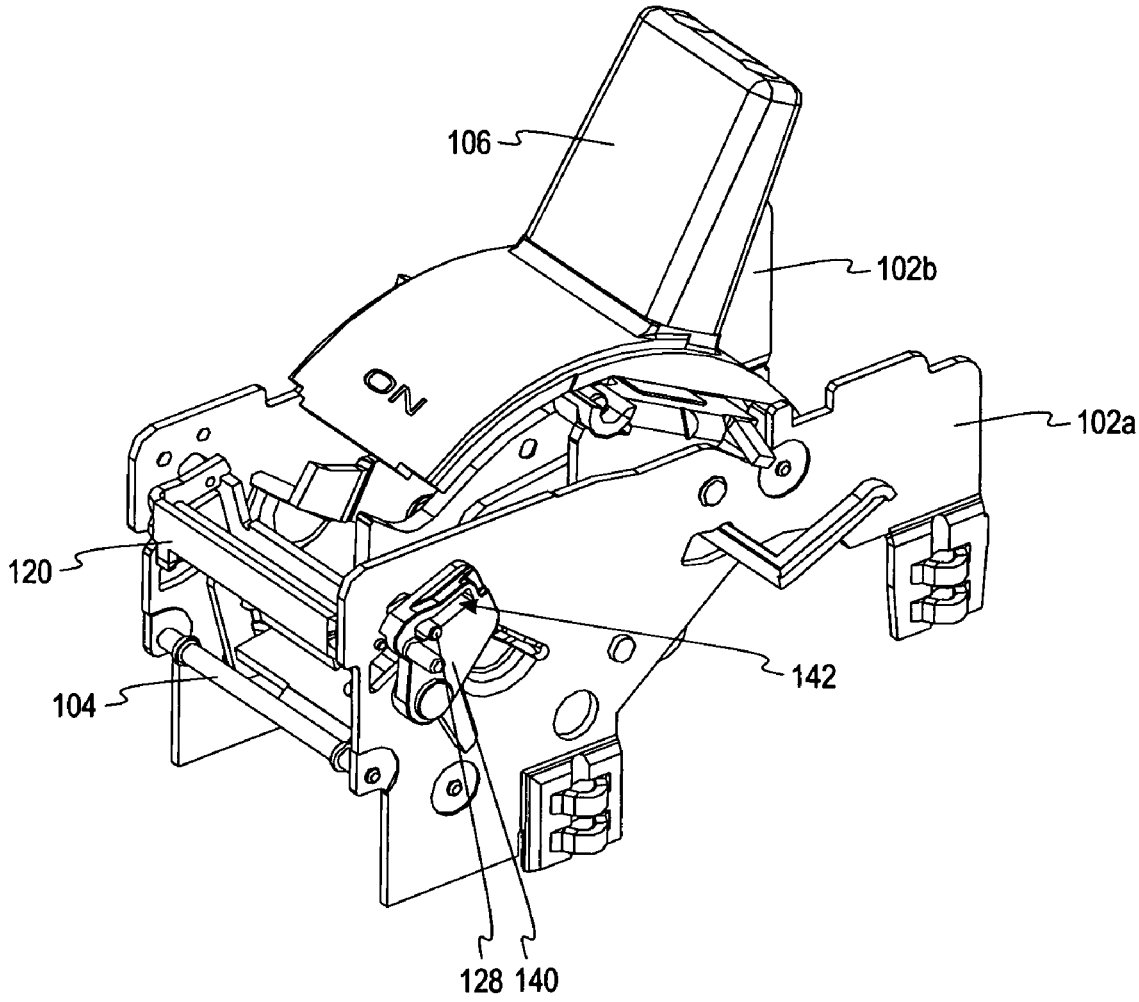
FIG. 1*b* is the same perspective view shown in FIG. 1*a*, with the breaker in the engaged or closed position.

Turning now to the drawings, and referring initially to FIGS. 1*a* and 1*b*, a switch mechanism 100 includes a pair of parallel chassis plates 102*a* and 102*b* held in position by spacing bars 104, only one of which is shown. A manually movable hand toggle 106 is coupled to internal components, described further below, for the purpose of manually opening and closing the breaker contacts (not shown), and for engaging a latching mechanism described in detail below. To trip the breaker automatically, the latching mechanism is disengaged by an automated tripping mechanism to allow a spring force to open the breaker contacts. The hand toggle 106 can then be used to re-engage the latching mechanism and reset the breaker.

Figure 2A:
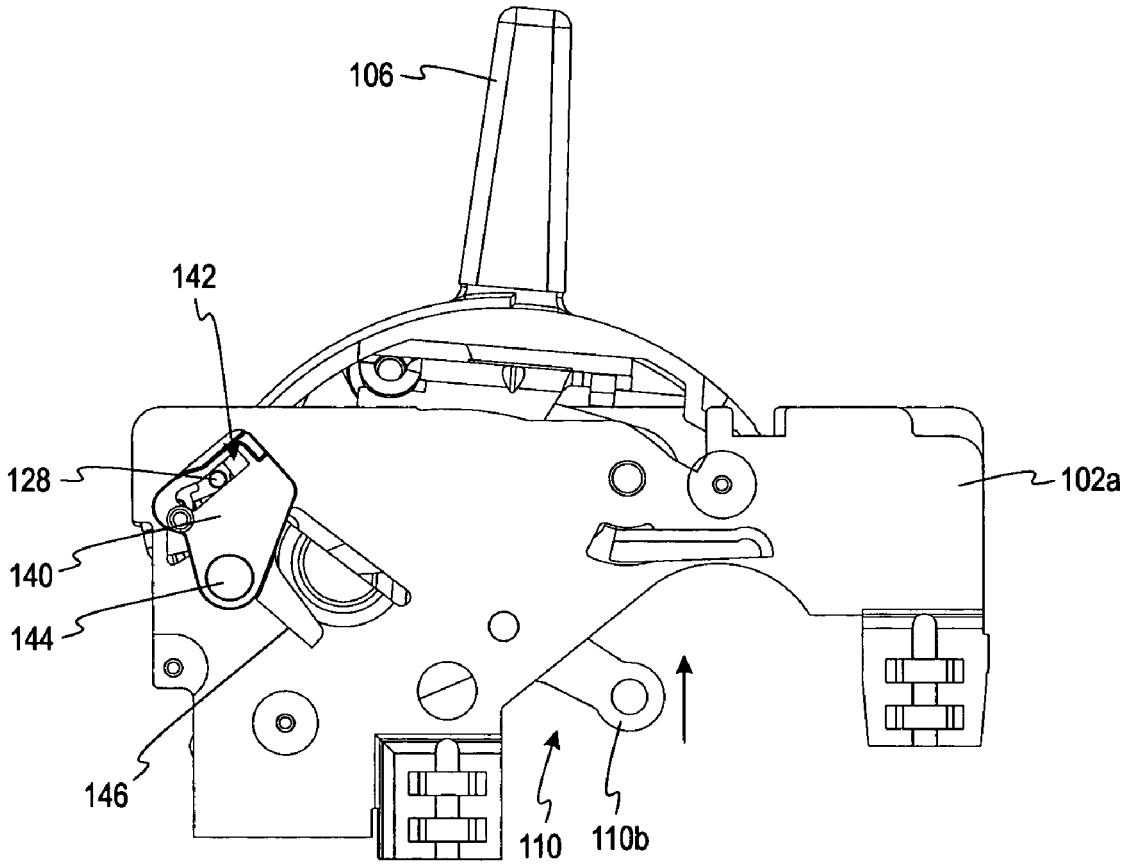
FIG. 2*a* is a side elevation of the circuit breaker as shown in FIG. 1*a;*
Figure 2B:
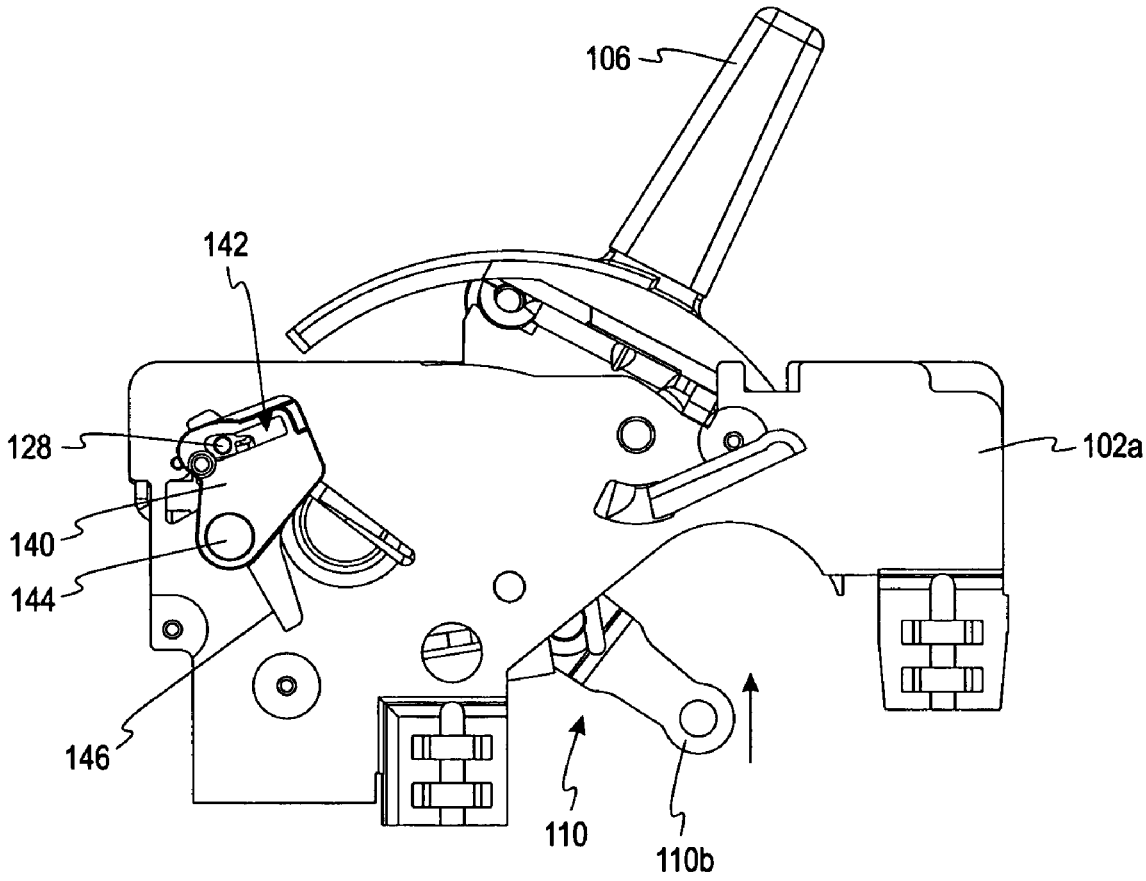
FIG. 2*b* is a side elevation of the circuit breaker as shown in FIG. 1*b;*
Figure 2C:
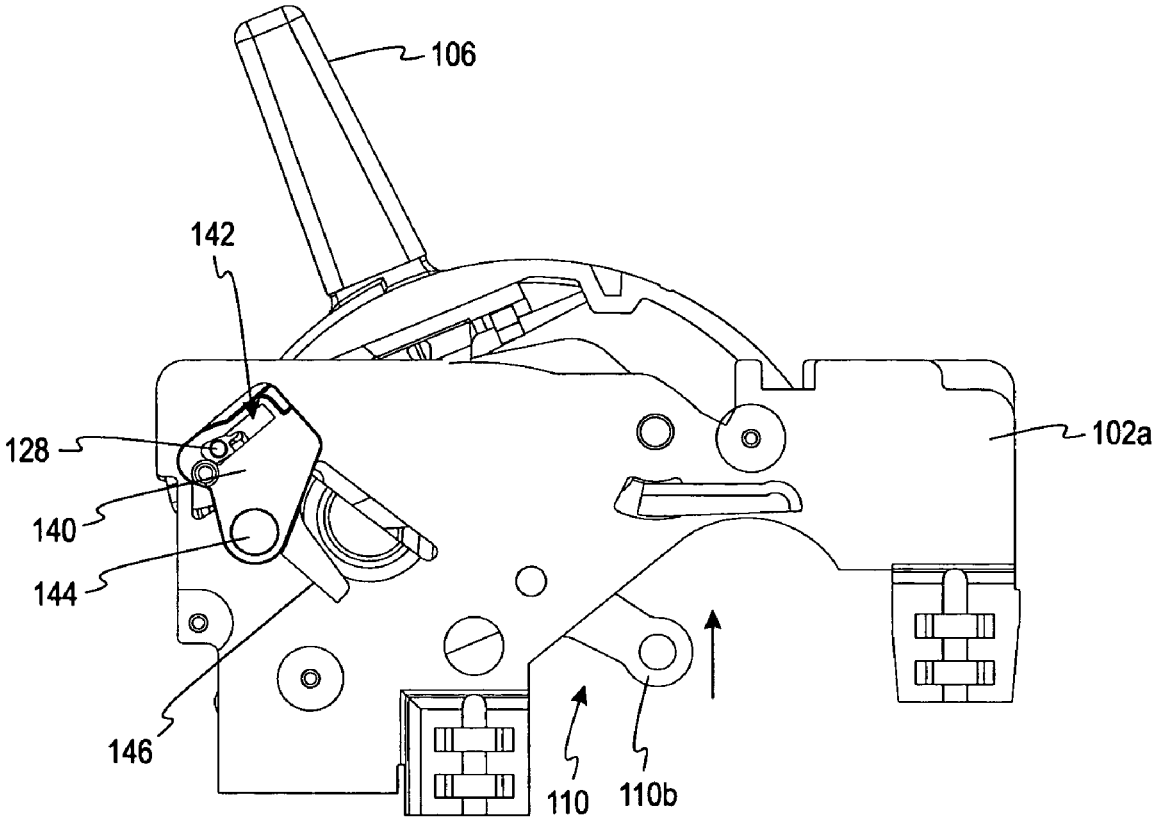
FIG. 2*c* is the same side elevation shown in FIG. 1*a* but with the manual toggle in the latched position.

The hand toggle 106 has three positions, center (FIGS. 1*a* and 2*a*), right (FIGS. 1*b* and 2*b*), and left (FIG. 2*c*). It should be noted that all directions (clockwise, counterclockwise, left, right, upwardly, etc.) referred to herein are referenced from the consistent point of view of the drawings. When the hand toggle 106 is in the left position (FIG. 2*c*), the breaker contacts are open, and the latching mechanism is latched. The hand toggle 106 can be manually moved back and forth between the left position ("off") and the right position ("on") shown in FIGS. 1*b* and 2*b* to open and close the breaker contacts manually without unlatching the latching mechanism.

The automated tripping mechanism is triggered when a fault condition is detected. If the hand toggle 106 is in the "on" position, the tripping mechanism releases the latching mechanism, causing the breaker contacts to open and the hand toggle 106 to be moved to the center position shown in FIGS. 1*a* and 2*a*. When it is desired to re-engage the latching mechanism, the toggle 106 is manually moved from the center position to the left ("off") position.

Figure 3A:
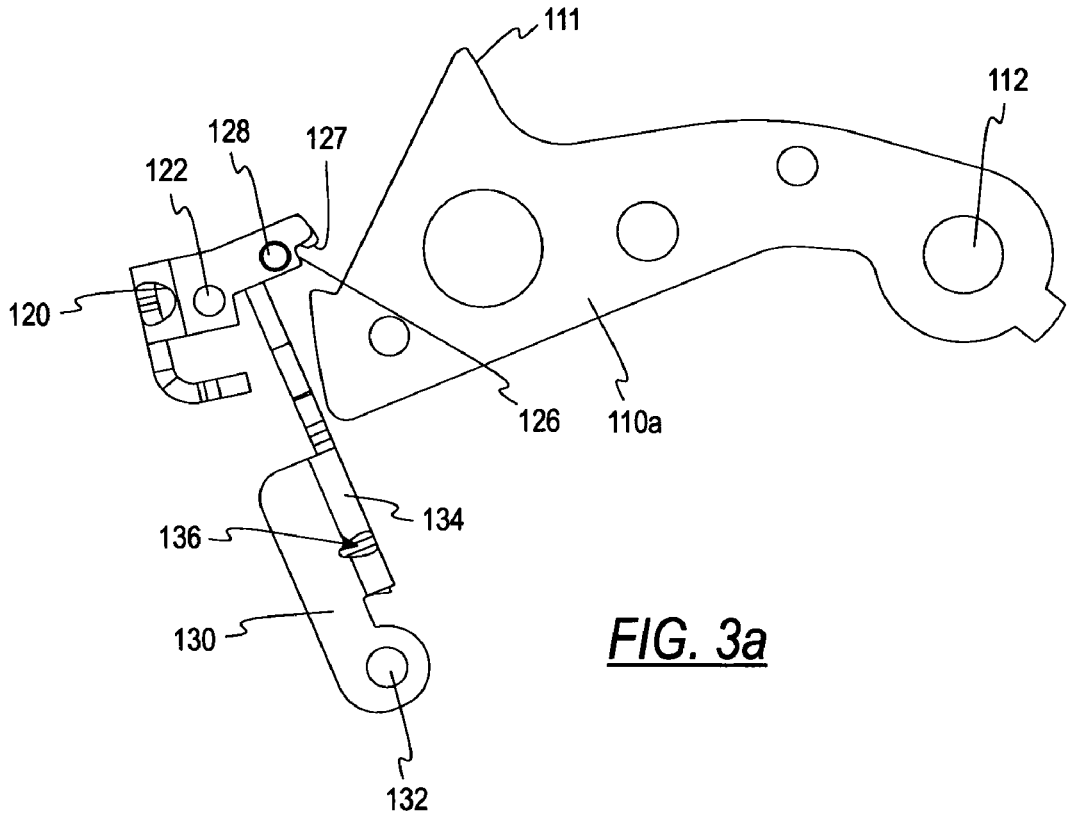
FIG. 3*a* is an enlarged side elevation of the primary latching mechanism in the circuit breaker as shown in FIGS. 1*a* and 2*a;*

FIGS. 1*a*, 2*a*, 3*a* and 4*a* show the circuit breaker with the hand toggle 106 in the center position, which means the breaker has been triggered to release the latching mechanism and open the breaker contacts. In this condition, a conventional crochet-link assembly 110 that controls movement of the movable breaker contact is in its raised position, as shown in FIG. 3*a*. The crochet-link assembly is formed by a crochet 110*a* and a lower link 110*b* pivotally mounted on one of the holes in the crochet. FIG. 3*a* shows the unlatched position of the crochet 110*a*, which means the breaker contacts are open. The crochet 110*a* is spring-biased to its raised position so that the breaker contacts are opened whenever the crochet 110*a* is released by the latching mechanism, such as upon the detection of a fault condition in the circuit protected by the breaker. To re-engage the latching mechanism, the hand toggle 106 is moved to its left ("off") position, and in the process engages a projection 111 formed by the upper edge of the crochet 110*a* to pivot the crochet in a counterclockwise direction about the axis of a shaft 112. As viewed in FIG. 3*a*, the crochet 110*a* is biased in the clockwise direction by a spring (not shown) that exerts a relatively high biasing force on the crochet. This biasing force is overcome by manually moving the hand toggle 106 to its left position, thereby pivoting the free end of the crochet 110*a* downwardly to its latched position shown in FIG. 3*b*.

Figure 6:
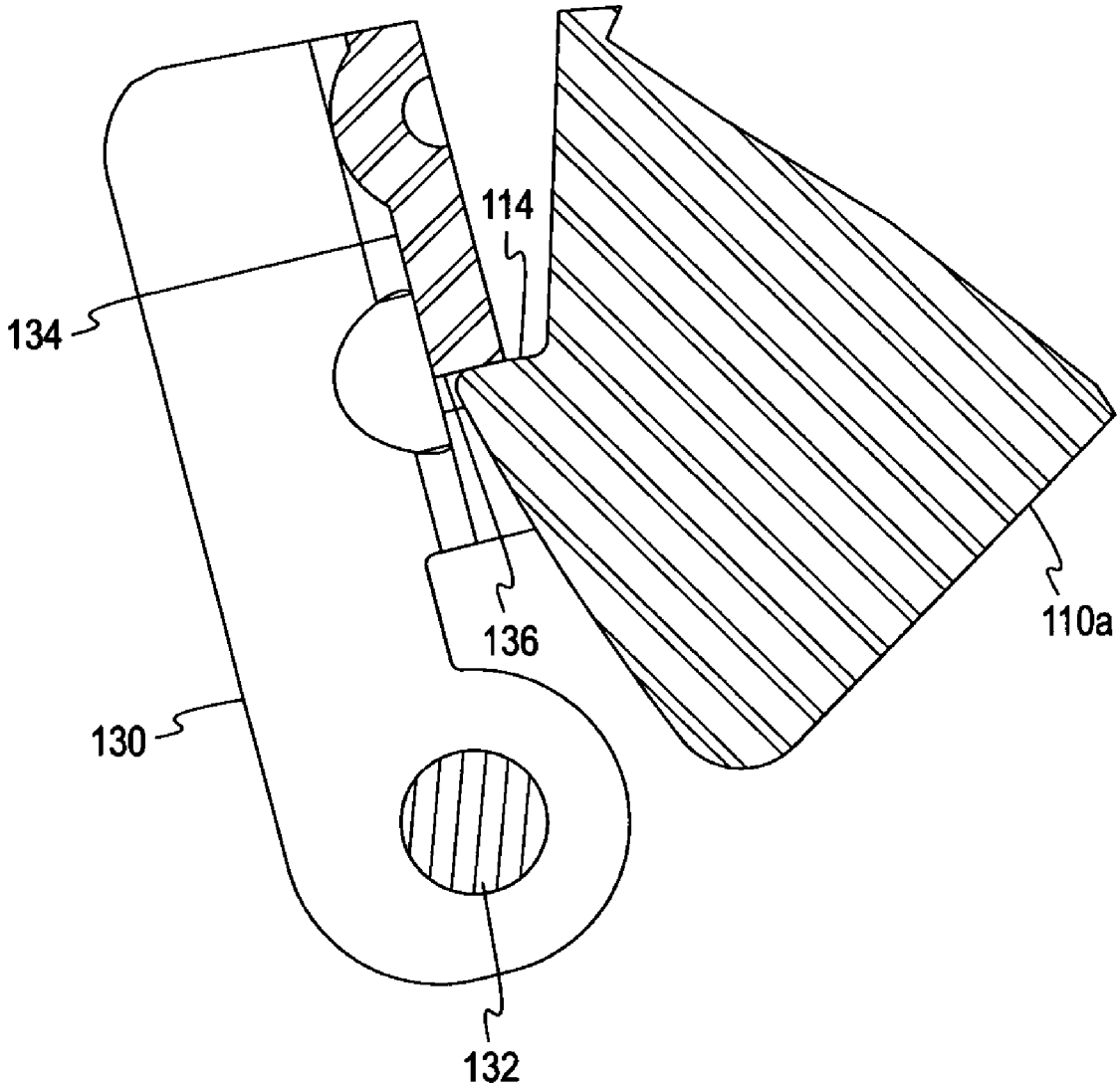
FIG. 6 is an enlarged sectional view of a pair of latching elements in the circuit breaker of FIGS. 1-5.

The two main components of the latching mechanism are a latch bar 120 and a latch plate 130. The latch bar 120 is mounted for pivoting movement about the axis of a shaft 122, and is biased in the clockwise direction by a light biasing spring (not shown). The latch plate 130 is mounted for pivoting movement about the axis of a shaft 132, and is biased in the clockwise direction by a light biasing spring (not shown). The plate 130 includes a lateral projection 134 that forms a lower surface 136 for engaging a shoulder 114 on the opposed edge of the crochet 110*a*, as shown in FIG. 6. When the two surfaces 136 and 114 are in engagement (FIGS. 3*b* and 6), the crochet 110*a* is latched and cannot be pivoted about its shaft 112 to open the breaker contacts.

Figure 7:
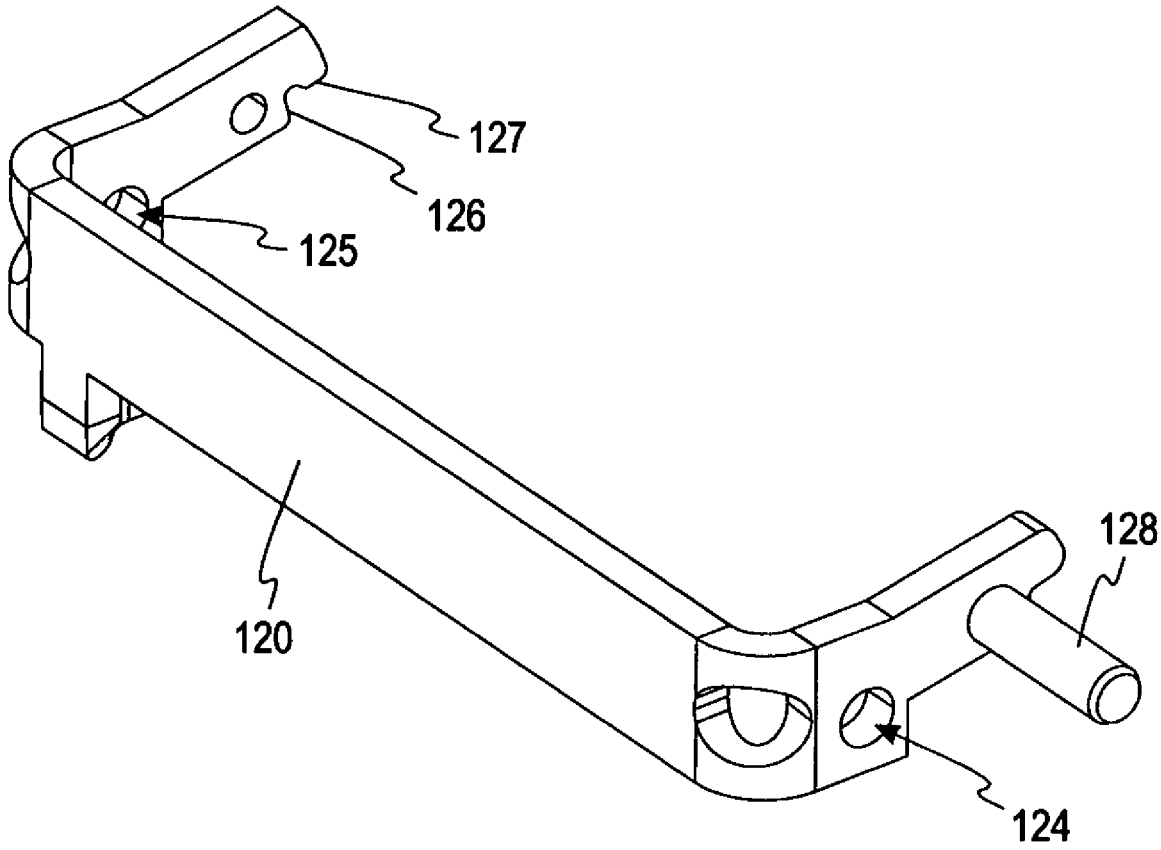
FIG. 7 is an enlarged perspective view of the latch-bar mechanism in the circuit breaker of FIGS. 1-6.

FIG. 7 shows the latch bar 120 in more detail. It can be seen that the latch bar 120 is a generally U-shaped member that pivots on a shaft 122 (FIGS. 3*a* and 3*b*) extending through a pair of apertures 124 and 125 in the latch bar. The latch bar 120 also forms a latch surface 126 and a stop surface 127 in the lower edge of one arm, and has a trip pin 128 extending laterally from the other arm. When the latch bar 120 is mounted between the chassis sidewalls 102*a* and 102*b*, the trip pin 128 protrudes through a slot in the adjacent chassis sidewall 102*a*. The trip pin 128 extends into a cam slot (described below) to function as a cam follower for controlling movement of the latch bar 120.

Figure 3B:
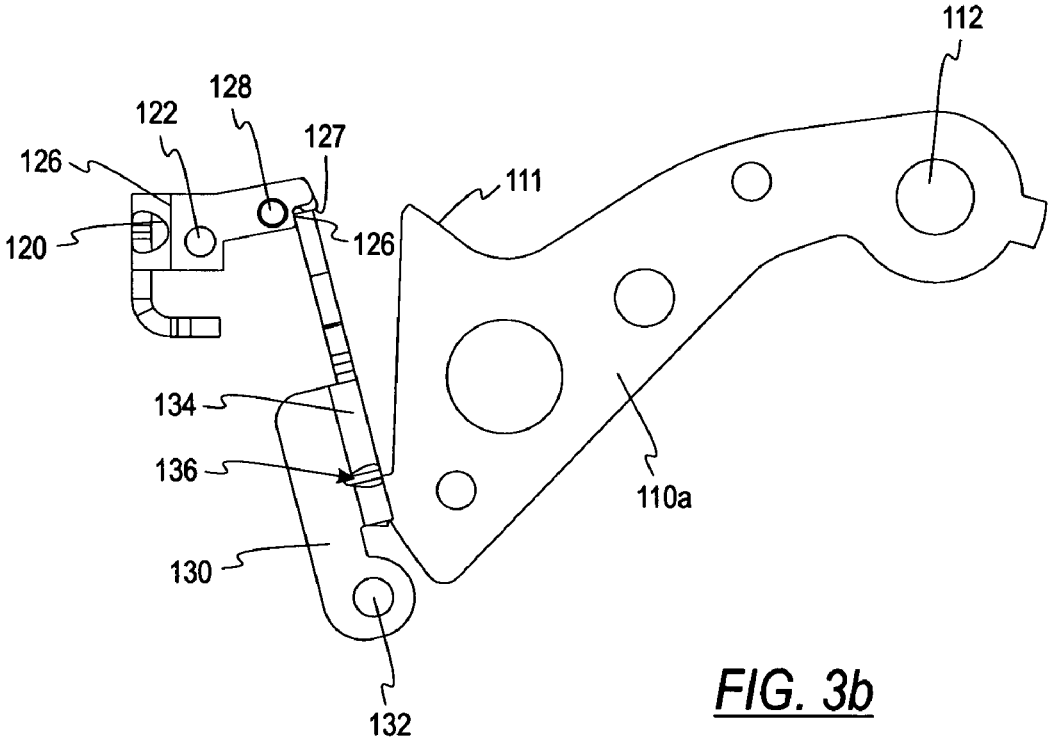
FIG. 3*b* is an enlarged side elevation of the primary latching mechanism in the circuit breaker as shown in FIGS. 1*b* and 2*b;*
Figure 4A:
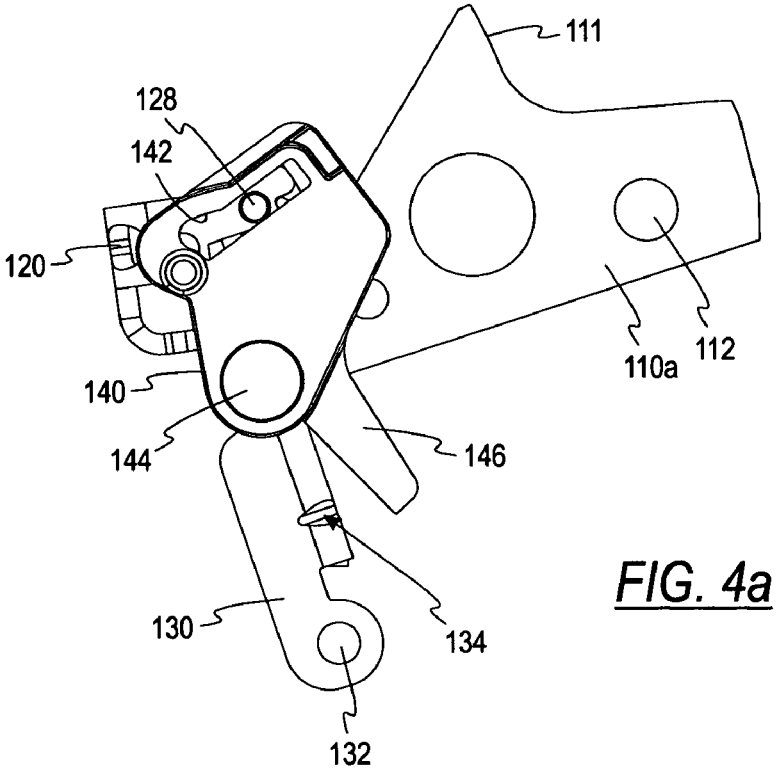
FIG. 4*a* is an enlarged side view of the secondary latching mechanism in the circuit breaker as shown in FIGS. 1*a*, 2*a* and 3*a;*
Figure 4B:
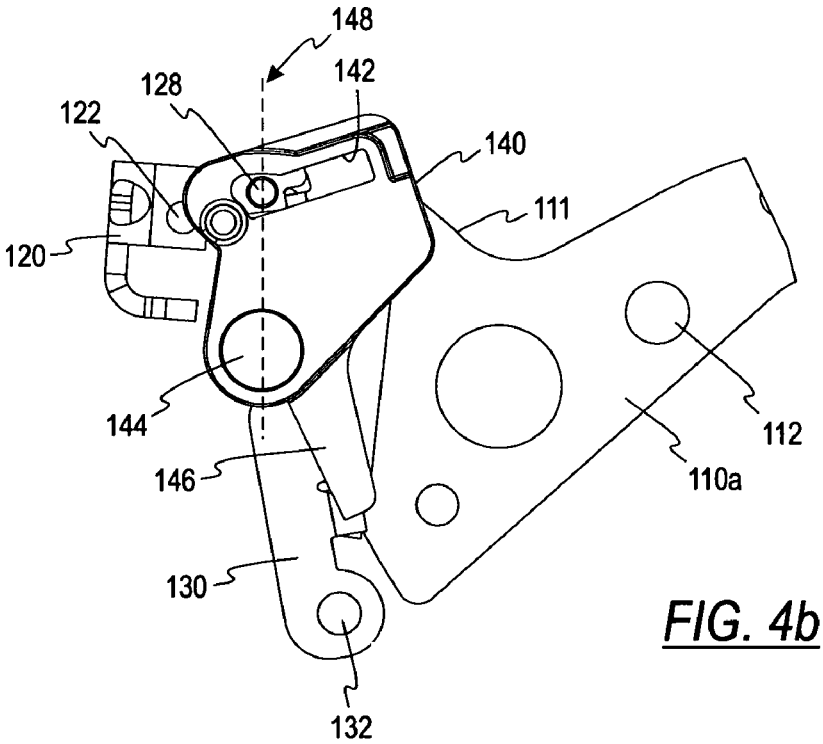
FIG. 4*b* is an enlarged side view of the secondary latching mechanism in the circuit breaker as shown in FIGS. 1*b*, 2*b* and 3*b;*

In the latched condition shown in FIG. 3*b*, the upper end of the latch plate 130 engages the stop surface 127, and the left side of the latch plate engages the latch surface 126 on the latch bar 120. In this condition, the latch plate 130 cannot be pivoted about its shaft 132, and thus the two latching surfaces 136 and 114 are held in engagement with each other. To release the latching mechanism, the latch bar 120 is rotated about its axis 128 in a counterclockwise direction, against the frictional and biasing forces, to pivot upwardly away from the upper edge of the plate 130, as shown in FIG. 3*a*. This allows the biasing force on the latch plate 130 to pivot the plate in a counterclockwise direction around its axis 132, thereby releasing the crochet 110*a*. The biasing force on the crochet 110*a* then pivots the crochet in the clockwise direction around its shaft 112 to open the breaker contacts. It can be seen from the enlarged view of the engaging surfaces 136 and 114 in FIG. 6 that the angle of these surfaces relative to the axes of the shafts 132 and 112 is such that the crochet 110*a* will push the plate 130 in a counterclockwise direction when the plate 130 is free to rotate. Thus, by rotating the latch bar 120 in a counterclockwise direction, the latch plate 130 is free to rotate counterclockwise which unlatches the crochet 110*a* so that the biasing force on the crochet pivots it in a clockwise direction to open the breaker contacts.

The trip pin 128 extends laterally outwardly from one end of the latch bar 120 into a cam slot 142 in a secondary latching element 140 mounted on the outer surface of the chassis plate 102*a*. When the latching mechanism is in its latched condition, engaging the crochet 110*a* and holding it in its lowered position as shown in FIG. 3*b*, the trip pin 128 is positioned near the left end of the cam slot 142. See FIGS. 1*b*, 2*b*, 4*b* and 5*b*. A spring bias on the secondary latching element 140 urges this element in a clockwise direction about the axis of its mounting shaft 144. The pin 128 is captured between the upper and lower edges of the cam slot 142, so that the upper edge of the cam slot 142 prevents upward movement of the pin 128 and thus holds the latch bar 120 in its latched position shown in FIGS. 1*b*, 3*b*, 4*b* and 5*b*. The secondary latching element 140 is mounted for pivoting movement about the axis of its shaft 144, but pivoting movement in a clockwise direction is limited by a mechanical stop (not shown here).

In many applications, the latch bar 120 can experience shocks on the order of 10 G's during the engagement process of bringing the crochet link assembly 110, the latch plate 130, and the latch bar 120 into mutual contacting positions.

To release the primary latching mechanism formed by the latch bar 120 and the latch plate 130, the secondary latching element 140 is pivoted in a counterclockwise direction so that the lower edge of the cam slot 142 pushes the trip pin 128 upwardly, thereby pivoting the latch bar 120 in a counterclockwise direction. This pivoting movement of the latching element 140 is caused by a trip mechanism (described below) that engages a depending arm 146 formed as an integral part of the latching element 140. The depending arm 146 provides a lever to rotate the secondary latching element 140 around the axis of its shaft 144 with minimal force.

The tripping of the latching mechanism by the upward movement of the trip pin 128 releases the crochet-link assembly 110 for movement to its raised position, as described previously. FIGS. 1*a*, 2*a*, 3*a*, 4*a* and 5*a* show the circuit breaker latching mechanism in the disengaged or tripped position, with the trip pin 128 re-positioned within the cam slot 142 and the toggle 106 moved to its center position (visually indicating a tripped condition).

Likewise in the closed state, any shock force attempting to rotate the latch bar 120 will exert a shock on the secondary latching element 140. By designing the upper left portion of the cam slot 142 as an arc about the shaft 144, there is no net moment created to try to rotate latch element 140 during a shock, thereby not allowing latch bar 120 rotation.

During a shock, if the cam slot 142 surface were to produce a clockwise moment on element 140, this would increase the required tripping force. If the cam slot 142 surface were to cause a counterclockwise shock moment, this would reduce the required tripping force, but would also increase the potential for an unintentional and undesired trip.

Figure 5A:
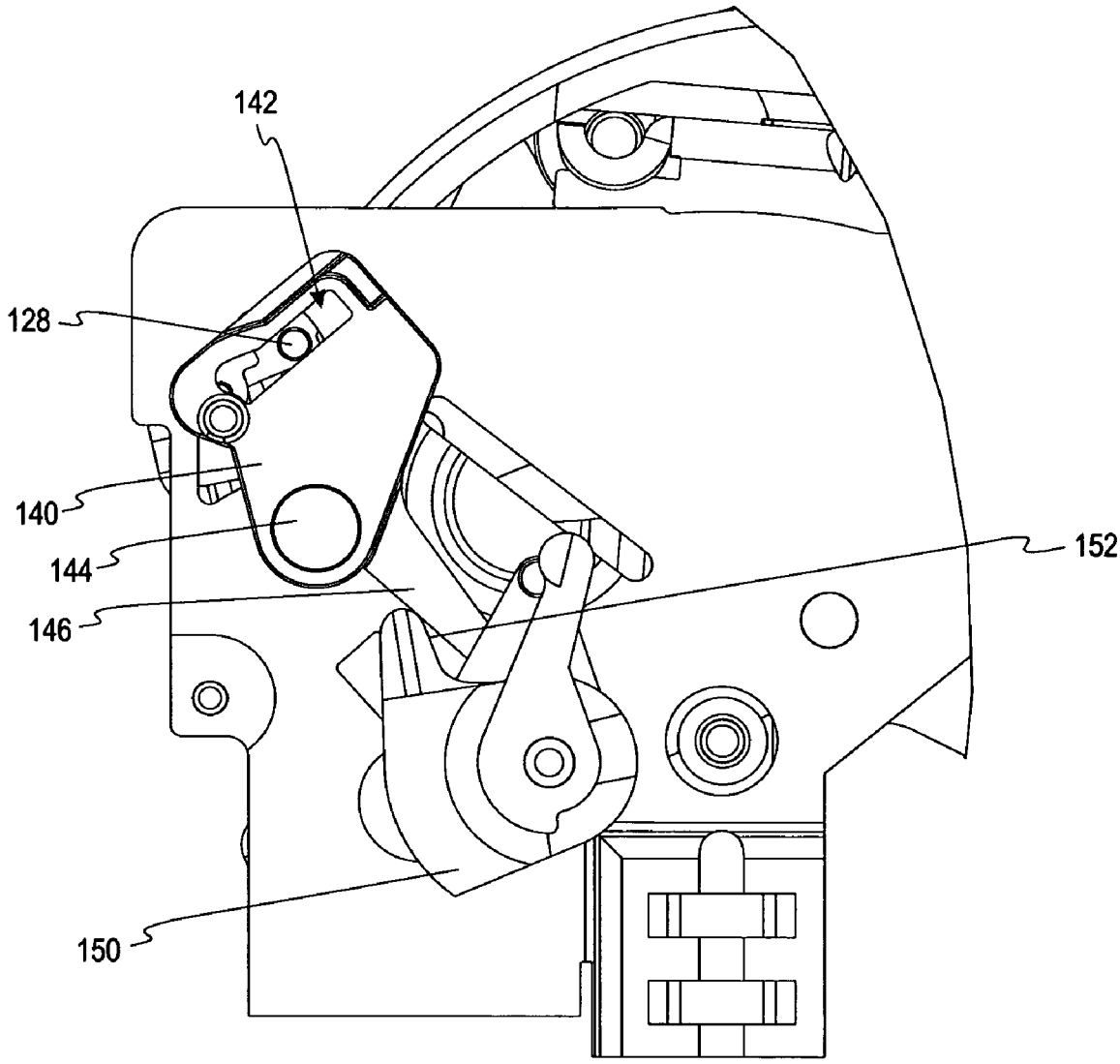
FIG. 5*a* is an enlarged side view of the secondary latching mechanism and the tripping mechanism in the circuit breaker as shown in FIGS. 1*a* and 2*a*, 3*a* and 4*a;*
Figure 5B:
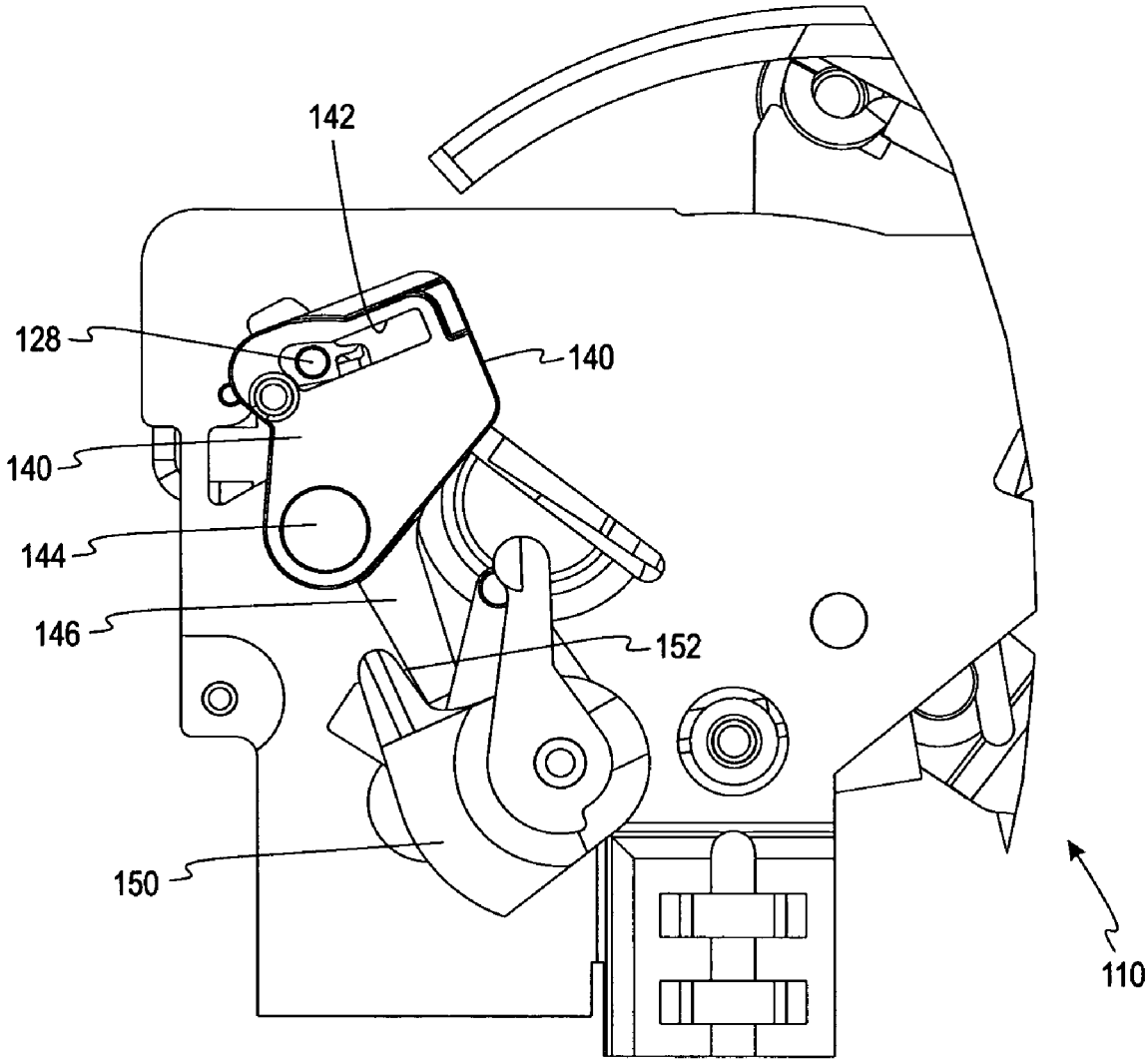
FIG. 5*b* is an enlarged side view of the secondary latching mechanism and the tripping mechanism in the circuit breaker as shown in FIGS. 1*b* and 2*b*, 3*b* and 4*b;*

FIGS. 5*a* and 5*b* show the relationship of the secondary latching element 140 with a trip mechanism 150. The user manually places the primary latching mechanism into the engaged state, as described previously. During the engagement process, the trip mechanism 150 is turned slightly counterclockwise, as shown. Surface 152 of the trip mechanism 150, in contact with the arm 146 of the secondary latching element 140, then allows the element 140 to rotate clockwise. The clockwise movement of the secondary latching element 140 places the trip pin 128 in the secure portion of the cam slot 142 to prevent inadvertent movement of the primary latching elements as described above. The trip mechanism 150 maintains this position while in the engaged state.

The disengagement of the primary latching mechanism occurs when the trip mechanism 150 is rotated clockwise to the position shown in FIG. 5*a*. The rotation of the trip mechanism is caused by conventional components, such as a solenoid, in response, for example, to a circuit fault indication. When the trip mechanism 150 is rotated clockwise, the secondary latching element 140 is rotated counterclockwise. The counterclockwise rotation of the secondary latching mechanism 140 cams the trip pin 128 upwardly, which in turn pivots the latch bar 120 counterclockwise to disengage the primary latching mechanism and permit the breaker contacts to spring open, as described previously.

While particular embodiments and applications of the present invention have been illustrated and described, it is to be understood that the invention is not limited to the specific embodiments disclosed herein and that various modifications, changes, and variations may be apparent from the foregoing descriptions without departing from the spirit and scope of the invention as defined in the appended claims.

The invention claimed is:

1. A circuit breaker latching mechanism for a movable member mounted for movement between first and second positions, said mechanism comprising:

a first latching element mounted for movement between a latched position where said first latching element releasably engages said movable member in said first position, and an unlatched position where said movable member is disengaged for movement to said second position;

a second latching element engaging a portion of said first latching element to hold said first latching element in said latched position, said second latching element being movable to move said first latching element to said unlatched position; and a third latching element being mounted to hold said second latching element in said latched position during an inadvertent tripping indication, said third latching element being movable to move said second latching element to said unlatched position in response to a circuit fault indication.

2. The circuit breaker latching mechanism of claim 1, wherein said movable member is coupled to a trip mechanism for an electrical circuit breaker, and said second latching element is subject to substantial mechanical shocks when said trip mechanism is moved to a closed position.

3. The circuit breaker latching mechanism of claim 1, wherein said second latching element includes a cam follower, and said third latching element forms a cam surface that engages said cam follower to move said second latching element between said latched and unlatched positions in response to movement of said third latching element.

4. The circuit breaker latching mechanism of claim 1, wherein said second latching element includes a cam follower, and said third latching element forms a cam surface that holds said second latching element in said latched position.

5. The circuit breaker latching mechanism of claim 4, wherein said third latching element is mounted for rotational movement around a fixed axis, and said cam surface is an arc having a substantially constant radius from said fixed axis so that forces received by said cam surface from said cam follower are transmitted to said fixed axis.

6. The circuit breaker latching mechanism of claim 4, wherein said third latching element forms a cam surface that engages said cam follower to move said second latching element between said latched and unlatched positions in response to movement of said third latching element.

7. The circuit breaker latching mechanism of claim 1, which includes a circuit breaker tripping mechanism for moving said third latching element.

8. The circuit breaker latching mechanism of claim 1, wherein said third latching element is mounted for rotational movement and includes an elongated arm to facilitate rotational movement of said third latching element in response to an applied force.

9. The circuit breaker latching mechanism of claim 1, wherein said third latching element remains in engagement with said second latching element as said second latching element is moved between said latched and unlatched positions.

10. The circuit breaker latching mechanism of claim 1, wherein said movable member is coupled to a movable breaker contact, said movable breaker contact having an open position in which said movable breaker contact is separated from a stationary breaker contact and a closed position in which said movable breaker contact is in contact with said stationary breaker contact, said first and second positions being associated with said open position and said closed position of said movable breaker contact.

11. A method of latching a circuit breaker member mounted for movement between first and second positions, said method comprising engaging said movable member with a first latching element mounted for movement between a latched position where said first latching element releasably engages said movable member in said first position, and an unlatched position where said movable member is disengaged for movement to said second position;

engaging a portion of said first latching element with a second latching element to hold said first latching element in said latched position, said second latching element being movable to move said first latching element to said unlatched position; and engaging a portion of said second latching element with a third latching element to hold said second latching element in said latched position during an inadvertent tripping indication, said third latching element being movable to move said second latching element to said unlatched position in response to a circuit fault indication.

12. The method of claim 11, wherein said movable member is coupled to a trip mechanism for an electrical circuit breaker, and said second latching element is subject to substantial mechanical shocks when said trip mechanism is moved to a closed position.

13. The method of claim 11, wherein said second latching element includes a cam follower, and said third latching element forms a cam surface that engages said cam follower to move said second latching element between said latched and unlatched positions in response to movement of said third latching element.

14. The method of claim 11, wherein said second latching element includes a cam follower, and said third latching element forms a cam surface that holds said second latching element in said latched position.

15. The method of claim 14, wherein said third latching element is mounted for rotational movement around a fixed axis, and said cam surface is an arc having a substantially constant radius from said fixed axis so that forces received by said cam surface from said cam follower are transmitted to said fixed axis.

16. The method of claim 14, wherein said third latching element forms a cam surface that engages said cam follower to move said second latching element between said latched and unlatched positions in response to movement of said third latching element.

17. The method of claim 11, which includes moving said third latching element with a circuit breaker tripping mechanism.

18. The method of claim 11, wherein said third latching element is mounted for rotational movement and includes an elongated arm to facilitate rotational movement of said third latching element in response to an applied force.

19. The method of claim 11, wherein said third latching element remains in engagement with said second latching element as said second latching element is moved between said latched and unlatched positions.

20. The method of claim 11, further comprising coupling said movable member to a movable breaker contact such that said first and second positions of said movable member are associated with an open position and a closed position of said movable breaker contact, said open position being a position in which said movable breaker contact is separated from a stationary breaker contact, said closed position being a position in which said movable breaker contact is in contact with said stationary breaker contact.

* * * * *